US009335670B2

(12) United States Patent
Kakita

(10) Patent No.: US 9,335,670 B2
(45) Date of Patent: May 10, 2016

(54) IMAGE FORMING APPARATUS AND IMAGE FORMING SYSTEM

(71) Applicant: Konica Minolta, Inc., Tokyo (JP)

(72) Inventor: Akihiko Kakita, Kunitachi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/724,338

(22) Filed: May 28, 2015

(65) Prior Publication Data

US 2015/0346644 A1 Dec. 3, 2015

(30) Foreign Application Priority Data

Jun. 3, 2014 (JP) ..... 2014-114962

(51) Int. Cl.
*G03G 21/00* (2006.01)
*B41J 15/04* (2006.01)
*G03G 15/16* (2006.01)

(52) U.S. Cl.
CPC ..... *G03G 15/161* (2013.01)

(58) Field of Classification Search
CPC ..... G03G 15/00; G03G 15/161; G03G 21/00; G03G 21/16; B41J 15/00; B41J 15/04; B41J 11/00; B65H 35/00; B65H 7/00; B65H 23/00; B65H 23/032
See application file for complete search history.

(56) References Cited

U.S. PATENT DOCUMENTS

2006/0115313 A1* 6/2006 Shaw ..... B41J 11/42 400/621
2009/0086005 A1* 4/2009 Ito ..... B41J 11/0025 347/171

FOREIGN PATENT DOCUMENTS

| | | | | |
|---|---|---|---|---|
| JP | 08073080 A | * | 3/1996 | B41J 15/04 |
| JP | 08337023 A | * | 12/1996 | B41J 15/04 |
| JP | 09249341 A | * | 9/1997 | B41J 15/04 |
| JP | H11-010970 A | | 1/1999 | |
| JP | 2003145860 A | * | 5/2003 | B41J 15/04 |
| JP | 2004226560 A | * | 8/2004 | G03G 21/14 |
| JP | 2006027013 A | * | 2/2006 | B41J 11/70 |
| JP | 2008126530 A | * | 6/2008 | B41J 29/38 |
| JP | 2009078524 A | * | 4/2009 | B41J 11/42 |

* cited by examiner

*Primary Examiner* — Nguyen Ha
(74) *Attorney, Agent, or Firm* — Lucas & Mercanti, LLP

(57) ABSTRACT

An image forming apparatus includes a conveying unit that conveys a recording medium S from an introduction conveying section to a transfer section. The conveying unit includes: a conveyance supporting base that is supported so as to be able to be inserted into and detached from the apparatus body via a movement mechanism, and a plurality of conveying members that is attached to the conveyance supporting base in a detachable manner, and that forms a conveying path through which the recording medium is conveyed.

8 Claims, 12 Drawing Sheets

100

Y1
X1
1
2
3
5
10
11
12
13
14
20
21
22
23
31
32
40
40Y
40M
40C
40K
41
42
43
44
45
50
51
52
60
65
70
71
80
81
82
83
91
92
96
S

IMAGE FORMING APPARATUS AND IMAGE FORMING SYSTEM

CROSS REFERENCE TO RELATED APPLICATION

This Application claims the priority of Japanese Patent Application No. 2014-114962 filed on Jun. 3, 2014, the contents of which is incorporated herein by reference.

BACKGROUND OF THE INVENTION

1. Field of the Invention

The present invention relates to an image forming apparatus applied to a copy machine, a printer, a facsimile device, or the like, and in particular, to an image forming apparatus that forms images on a recording medium wound into a roll shape and having an adhesive surface. Furthermore, the present invention relates to an image forming system using the image forming apparatus.

2. Description of the Related Art

There has been widely used an electrophotographic image forming apparatus in which a toner image formed on a photoreceptor is transferred to a sheet or other transfer materials via a transfer section such as an intermediate transfer belt, the sheet having the toner image transferred thereon is heated and pressurized in a fixing section, whereby the toner image is fixed on the sheet.

Moreover, in an electrophotographic image forming apparatus, there is proposed a technique which employs a recording medium wound into a roll shape (hereinafter, referred to as a roll sheet) as a recording medium (see Patent Literature 1). In the case where such a roll sheet, which continuously extends in the sheet conveying direction, is conveyed, a guide section that performs side regulation on the sheet supply side is provided, and the roll sheet is conveyed while a certain level of tension is applied thereto, in order to prevent the sheet from meandering during conveyance.

RELATED ART DOCUMENT

Patent Literature

Patent Literature 1: Japanese Patent Laid-Open Publication No. 11-10970

DISCLOSURE OF THE INVENTION

Problems to be Solved by the Invention

However, in recent years, a recording medium having one side with an adhesive surface (hereinafter, referred to as a label roll sheet) has also been used. In the case where the label roll sheet is used as the recording medium, the adhesive agent coming out from end portions of the label roll sheet adheres to conveying rollers that convey the label roll sheet, or adheres to a regulation member provided for the purpose of preventing the label roll sheet from meandering. In addition, when the adhesive agent from the label roll sheet adheres to the conveying rollers or the regulation member, the agent adversely affects sheet conveyance properties.

For these reasons, conventionally, the conveying roller or regulation member, which becomes stained due to adhesion of the adhesive agent, needs to be cleaned after the image forming processing is performed to some extent. Additionally, during the time when the conveying roller or the regulation member is cleaned, the image forming processing needs to be interrupted because the sheet cannot be conveyed, and thus operational efficiency of the apparatus is reduced.

The present invention has been made in view of the existing problems described above, and an object of the present invention is to provide an image forming apparatus and an image forming system, which can prevent a reduction in operational efficiency even during the time when the conveying roller or the regulation member is cleaned.

SUMMARY OF THE INVENTION

In order to solve the problems described above and achieve an object of the present invention, the present invention provides an image forming apparatus that conveys, from an introduction conveying section, a recording medium wound into a roll shape and having an adhesive surface, and that forms an image on the recording medium. The image forming apparatus includes a transfer section that transfers a toner image formed by an image forming section, to the recording medium; a conveying unit that conveys the recording medium from the introduction conveying section to the transfer section; and an apparatus body that accommodates the transfer section and the conveying unit. The conveying unit includes: a conveyance supporting base that is supported so as to be able to be inserted into and detached from the apparatus body via a movement mechanism, and a plurality of conveying members that is attached to the conveyance supporting base in a detachable manner, and that forms a conveying path through which the recording medium is conveyed.

Furthermore, an image forming system according to the present invention includes an image forming apparatus according to the present invention described above, and a sheet feeding device that feeds the recording medium to the image forming apparatus.

DESCRIPTION OF THE PREFERRED EMBODIMENTS

Hereinafter, an exemplary embodiment (hereinafter, referred to as this example) for carrying out an image forming apparatus and an image forming system according to the present invention will be explained with reference to FIG. 1 to FIG. 12. Note that the same reference signs are attached to portions common to these drawings. Furthermore, the present invention is not limited to the following modes.

1. Configuration of Image Forming System

First, an image forming system according to this example will be explained with reference to FIG. 1.

Figure 1:
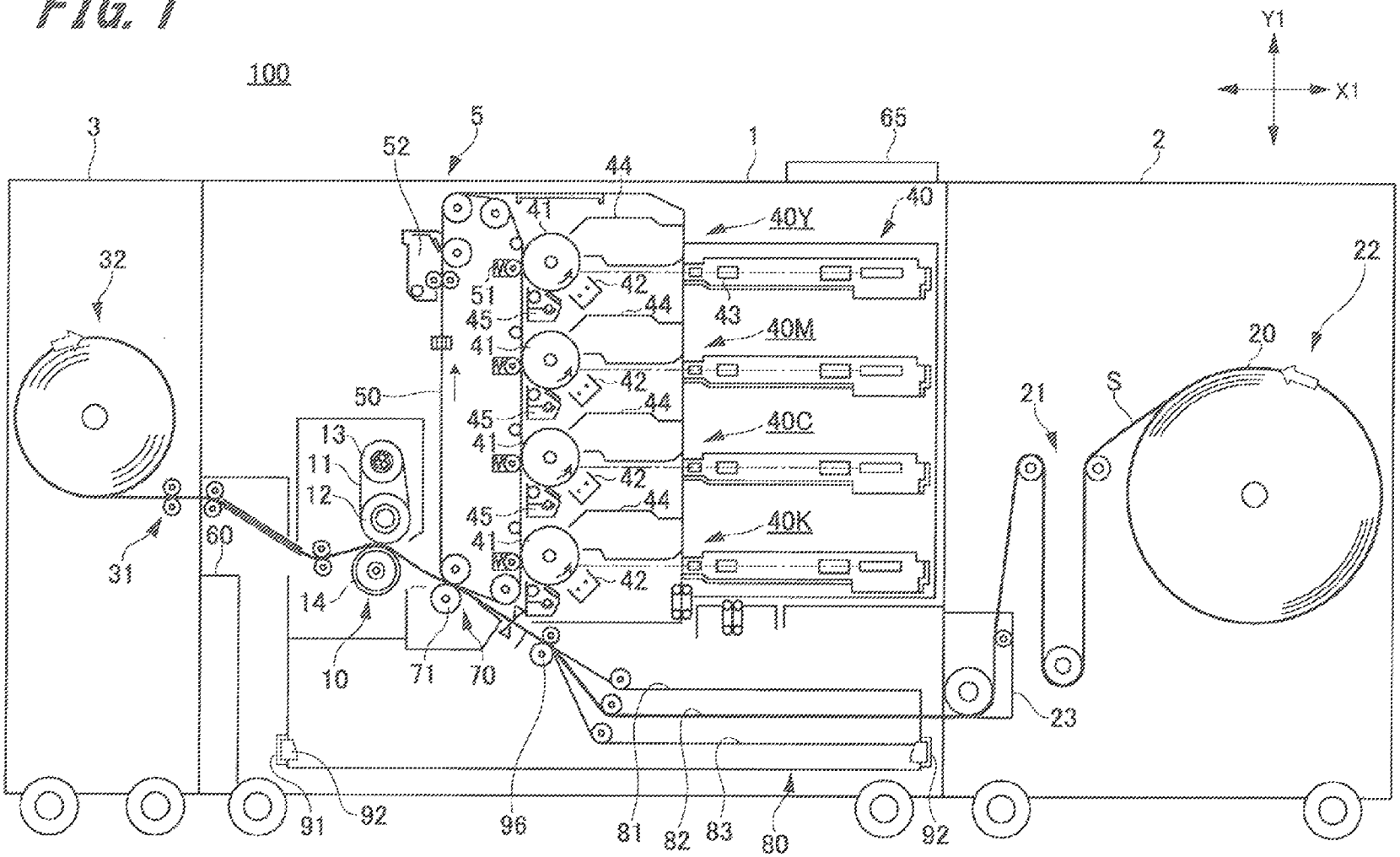
FIG. 1 is a schematic configuration diagram of an image forming system according to an example of an embodiment of the present invention.

FIG. 1 is a schematic configuration diagram of an image forming system 100.

As illustrated in FIG. 1, the image forming system 100 includes an image forming apparatus 1, a sheet feeding device 2 that feeds a label roll sheet S to the image forming apparatus 1, and a sheet ejection device 3 that winds the label roll sheet S ejected from the image forming apparatus 1. Furthermore, the image forming system 100 according to this example employs the label roll sheet S wound into a roll shape and having an adhesive surface, as a recording medium.

[Image Forming Apparatus]

Next, the image forming apparatus 1 will be explained. The image forming apparatus 1 forms an image on the label roll sheet S through an electrophotographic system, and is a tandem-type color image forming apparatus, in which toners with four colors of yellow (Y), magenta (M), cyan (C), and black (Bk), are superposed.

As illustrated in FIG. 1, the image forming apparatus 1 according to the present embodiment includes a conveying unit 80, an image forming section 40, an intermediate transfer belt 50, a secondary transfer section 70, a fixing section 10, an operation display section 65, and a control section 60. Furthermore, the image forming apparatus 1 includes an apparatus body 5 that accommodates the conveying unit 80, the image forming section 40, the intermediate transfer belt 50, the secondary transfer section 70, the fixing section 10, the operation display section 65, and the control section 60.

The conveying unit 80 includes a first conveying path 81, a second conveying path 82, and a third conveying path 83, which are arranged at intervals in the vertical direction Y1 that is perpendicular to the sheet conveying direction X1 and that is parallel to the front and the back faces of the label roll sheet S. Furthermore, the conveying unit 80 continuously conveys the label roll sheet S conveyed from the sheet feeding device 2 to the secondary transfer section 70 being a transfer position. Note that the detailed configuration of the conveying unit 80 will be described later.

The image forming section 40 includes four image forming units 40Y, 40M, 40C, and 40K in order to forma toner image of each color of yellow (Y), magenta (M), cyan (C), and black (Bk).

The first image forming unit 40Y forms the toner image of yellow, and the second image forming unit 40M forms the toner image of magenta. In addition, the third image forming unit 40C forms the toner image of cyan, and the fourth image forming unit 40K forms the toner image of black. These four image forming units 40Y, 40M, 40C, and 40K have the same configuration, and thus the first image forming unit 40Y will be explained as a representative image forming unit.

The first image forming unit 40Y includes a drum-shaped photoreceptor 41, and further includes a charging section 42, an exposure section 43, a developing section 44, and a cleaning device 45 which are disposed around the photoreceptor 41. The photoreceptor 41 is rotated by a driving motor (not illustrated) in a counterclockwise direction. The charging section 42 gives an electric charge to the photoreceptor 41 to uniformly charge the surface of the photoreceptor 41. The exposure section 43 performs exposure and scanning to the surface of the photoreceptor 41 on the basis of image data transmitted from the outside, and forms an electrostatic latent image on the photoreceptor 41.

The developing section 44 causes yellow toner to adhere onto the electrostatic latent image formed on the photoreceptor 41. With this operation, a toner image of yellow is formed on the surface of the photoreceptor 41. Note that the developing section 44 for the second image forming unit 40M causes magenta toner to adhere onto the photoreceptor 41, and the developing section 44 for the third image forming unit 40C causes cyan toner to adhere onto the photoreceptor 41. In addition, the developing section 44 for the fourth image forming unit 40K causes black toner to adhere onto the photoreceptor 41.

The toner adhering onto the photoreceptor 41 is transferred to the intermediate transfer belt 50. The cleaning device 45 removes the toner remaining on the surface of the photoreceptor 41 after the toner is transferred to the intermediate transfer belt 50.

The intermediate transfer belt 50 is formed into an endless shape, and rotates by a driving motor (not illustrated) in a clockwise direction, which is the opposite direction to rotation of the photoreceptor 41. A primary transfer section 51 is provided in a position in the intermediate transfer belt 50 facing the photoreceptor 41 of each of the image forming units 40Y, 40M, 40C, and 40K. This primary transfer section 51 applies a polarity opposite to that of the toner, to the intermediate transfer belt 50 to thereby transfer the toner image formed on the photoreceptor 41 to the intermediate transfer belt 50.

Furthermore, the toner images formed by the four image forming units 40Y, 40M, 40C, and 40K are sequentially transferred to the surface of the intermediate transfer belt 50 by the rotation of the intermediate transfer belt 50. With this configuration, toner images with yellow, magenta, cyan, and black are superposed on the intermediate transfer belt 50, whereby a color image is formed.

The secondary transfer section 70 is disposed in the vicinity of the intermediate transfer belt 50 and on the downstream side of the conveying unit 80. The secondary transfer section 70 is constituted of a paired transfer rollers each including a transfer upper roller around which the intermediate transfer belt 50 is stretched, and a transfer lower roller 71 that is pressed against the transfer upper roller side with the intermediate transfer belt 50 being disposed therebetween.

In the secondary transfer section 70, the label roll sheet S conveyed from the conveying unit 80 is pressed against the intermediate transfer belt 50 side by using the transfer lower roller 71. Then, the secondary transfer section 70 transfers the color toner image formed on the intermediate transfer belt 50 to the sheet S conveyed from the conveying unit 80. A cleaning section 52 removes the toner remaining on the surface of the intermediate transfer belt 50 after the color toner image is transferred to the label roll sheet S.

Furthermore, the fixing section 10 is disposed on an ejection side of the label roll sheet S in the secondary transfer section 70. The fixing section 10 includes a fixing belt 11, and a pressurizing roller 14 serving as a pressurizing member. The fixing belt 11 is constituted of an endless-shaped elastic member, and is supported by and stretched over a fixing roller 12 serving as a driving roller and a heating roller 13 serving as a driven roller.

In addition, a fixing nip portion is formed at a portion where the fixing belt 11 and the pressurizing roller 14 are brought into contact with each other. The roll sheet S carrying the toner image passes through the fixing nip portion of the fixing section 10, and thus toner melts with the fixing belt 11 and the pressurizing roller 14 which are controlled so as to have a predetermined temperature, whereby the toner is fixed to the roll sheet S.

The operation display section 65 is a touch panel including a display such as a liquid crystal display device (LCD) and an organic ELD (electro luminescence display). This operation display section 65 displays, for example, an instruction menu for a user, information on image data acquired, or the like. In addition, the operation display section 65 includes a plurality of keys, and serves as an input section that receives input of data such as various instructions, letters, and numerals made through key operations by the user.

Figure 9:
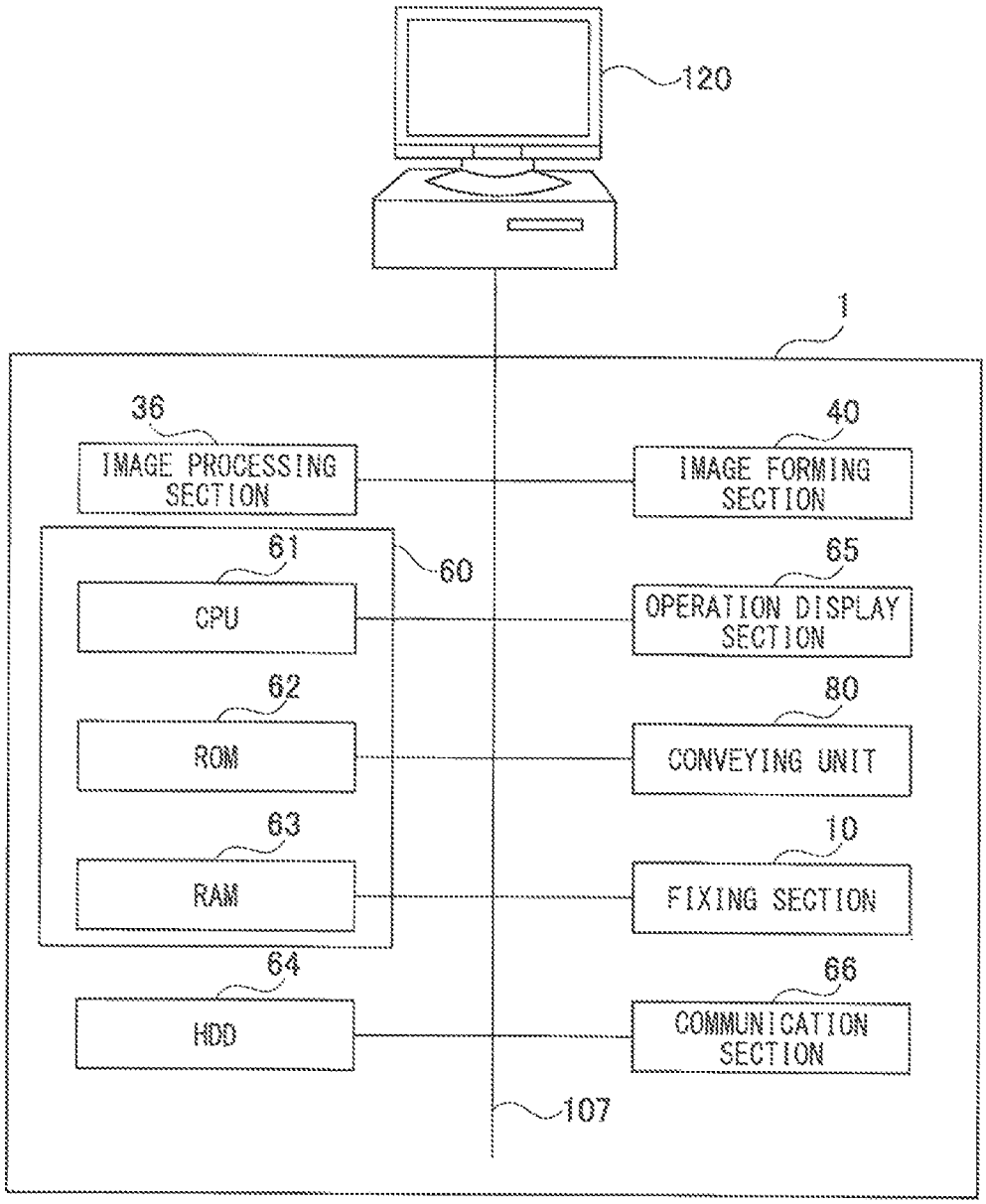
FIG. 9 is a block diagram illustrating a configuration of a control system of an image forming apparatus according to the example of the embodiment of the present invention.

The control section 60 operates each section in the image forming apparatus 1 in accordance with instructions from the operation display section 65 or a personal computer 120 externally connected (see FIG. 9).

[Sheet Feeding Device and Sheet Ejection Device]

Next, the sheet feeding device 2 and the sheet ejection device 3 will be explained. The sheet feeding device 2 includes a roll-sheet placement section 22, a conveying section 21, and an introduction conveying section 23. The roll-sheet placement section 22 is provided with a desired roll sheet body 20 in a rotatable manner. Furthermore, the conveying section 21 is constituted of a plurality of conveying rollers, and conveys the label roll sheet S ejected from the roll-sheet placement section 22 to the introduction conveying section 23.

The introduction conveying section 23 is supported by an apparatus body of the sheet feeding device 2 in a movable manner along the vertical direction Y1. The introduction conveying section 23 conveys the label roll sheet S conveyed from the conveying section 21 to the conveying unit 80 in the image forming apparatus 1. Furthermore, the introduction conveying section 23 moves along the vertical direction Y1, and thus the label roll sheet S is conveyed to a predetermined conveying path among the first conveying path 81, the second conveying path 82, and the third conveying path 83 of the conveying unit 80 (see FIG. 3).

Note that, in this example, there has been explained an example in which the introduction conveying section 23 is provided in the sheet feeding device 2, but the configuration is not limited to this. It may be possible to provide the introduction conveying section 23 in the image forming apparatus 1.

The sheet ejection device 3 includes a conveying section 31, and a winding section 32. The conveying section 31 is constituted of a plurality of conveying rollers, and conveys the label roll sheet S ejected to the sheet ejection device 3 to the winding section 32 side. The winding section 32 winds the conveyed label roll sheet S into a roll shape.

[Conveying Unit]

Next, the configuration of the conveying unit 80 will be explained with reference to FIG. 2 to FIG. 8.

Figure 2:
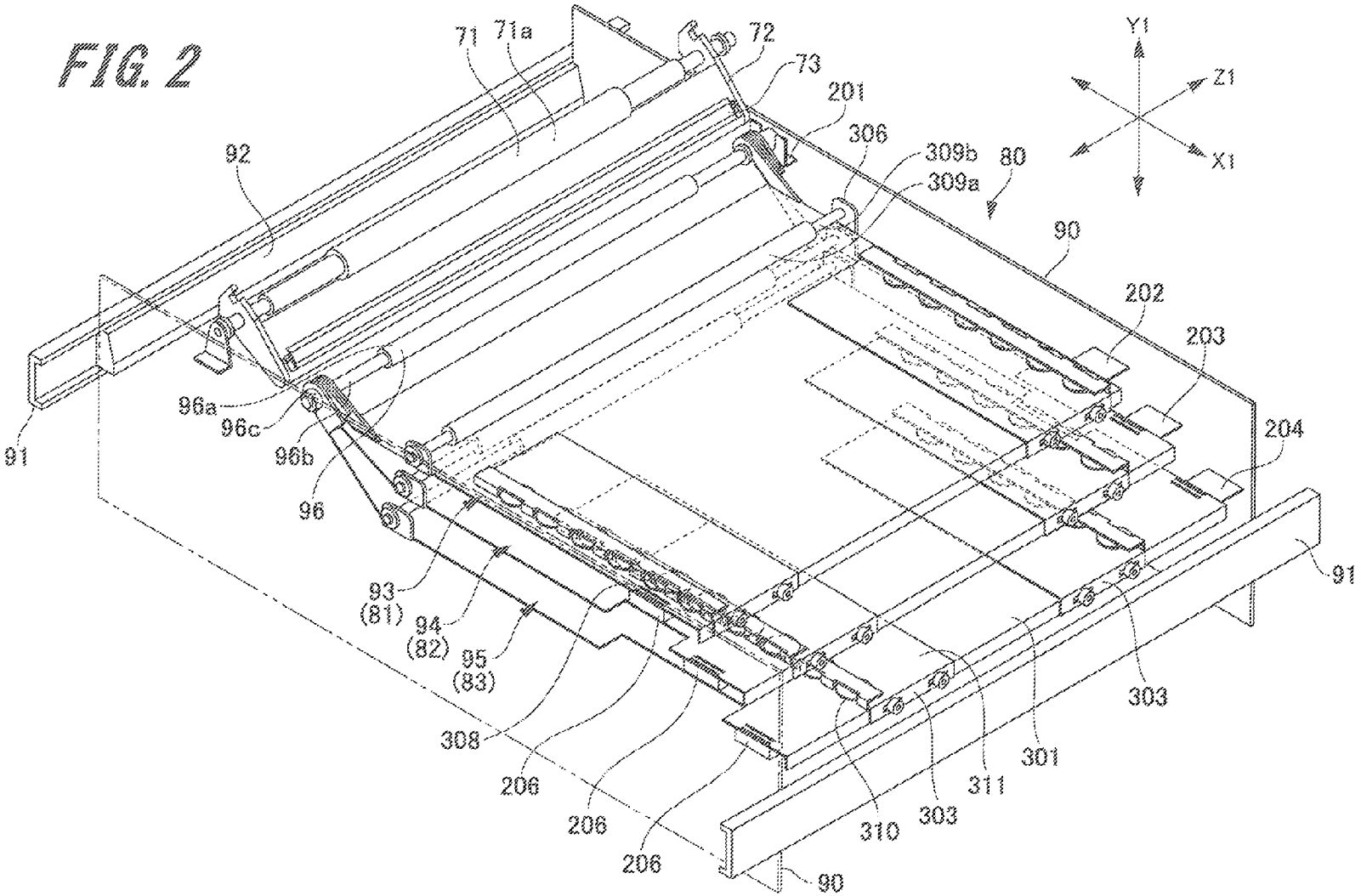
FIG. 2 is a schematic configuration diagram of a conveying unit according to the example of the embodiment of the present invention.
Figure 3:
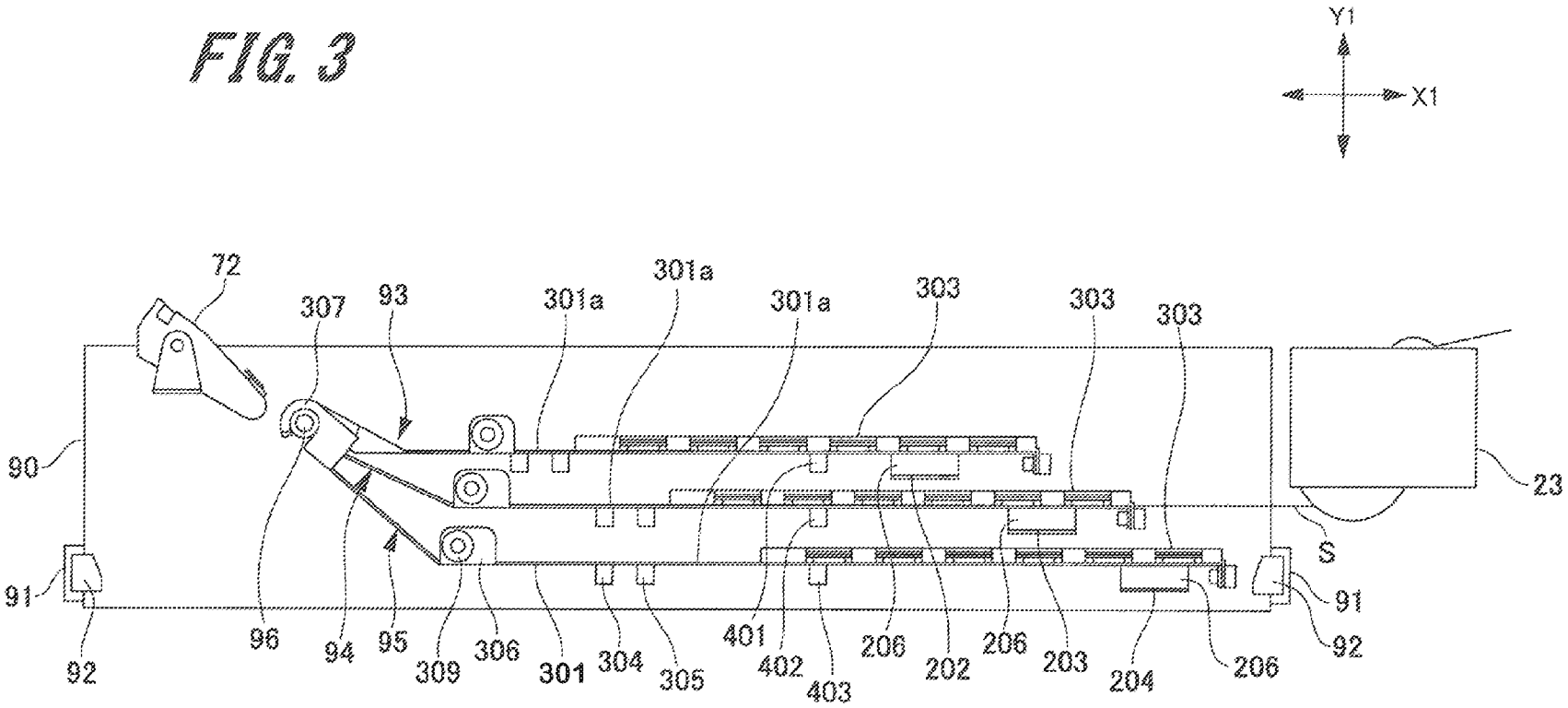
FIG. 3 is an elevation view illustrating the conveying unit according to the example of the embodiment of the present invention.
Figure 4:
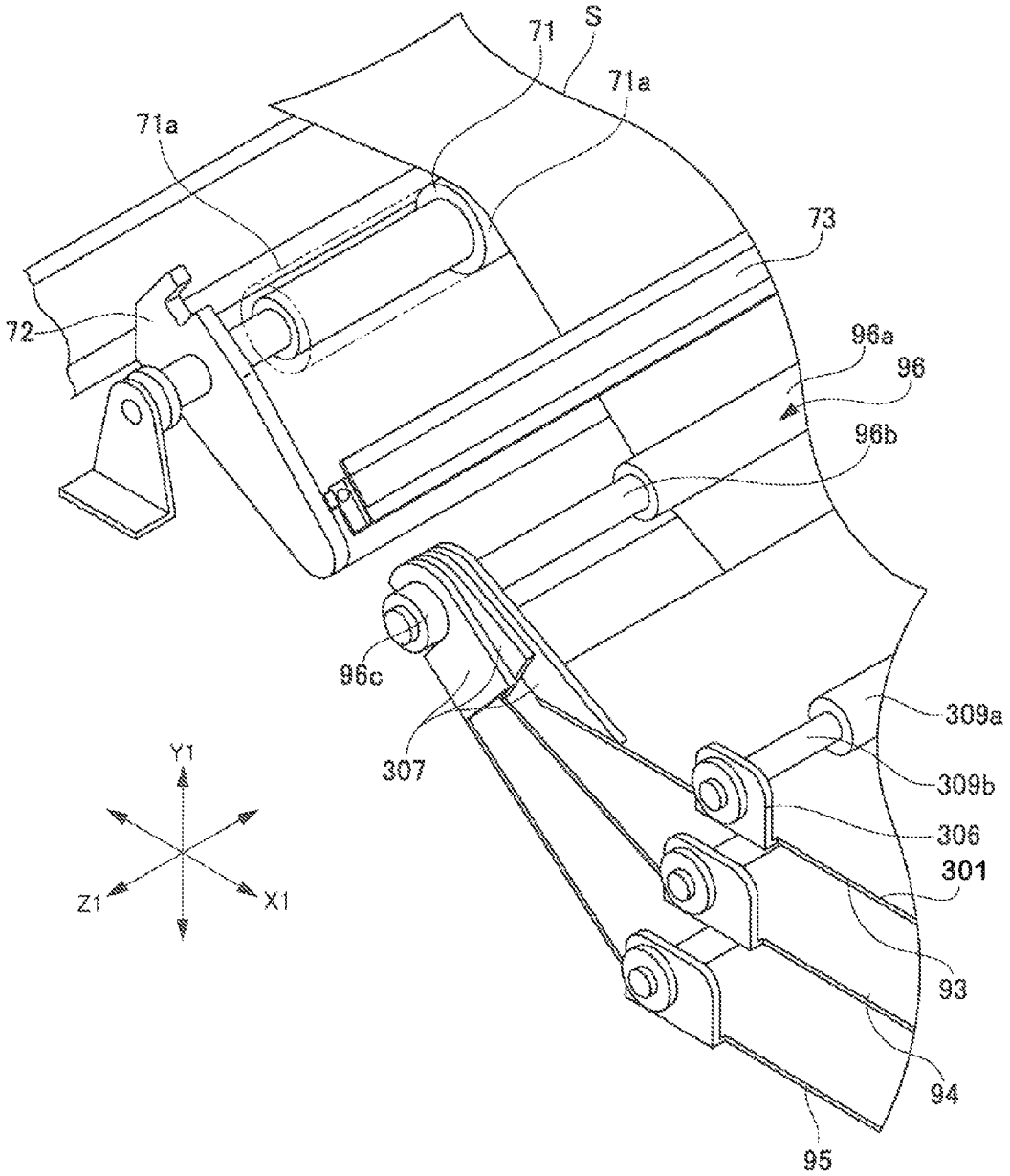
FIG. 4 is a perspective view illustrating the conveying unit according to the example of the embodiment of the present invention, shown by enlarging main portions.
Figure 5:
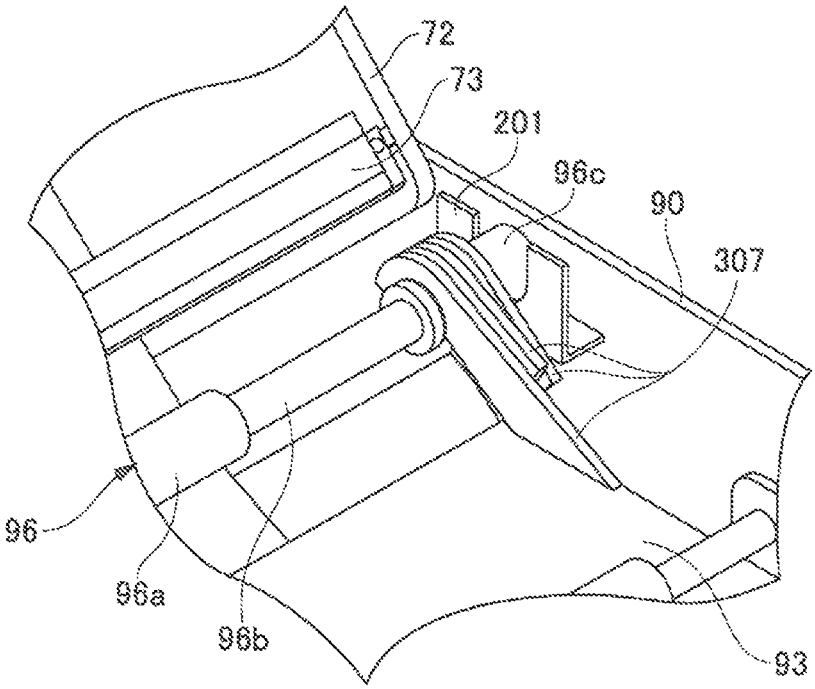
FIG. 5 is a perspective view illustrating the conveying unit according to the example of the embodiment of the present invention, shown by enlarging main portions.
Figure 6:
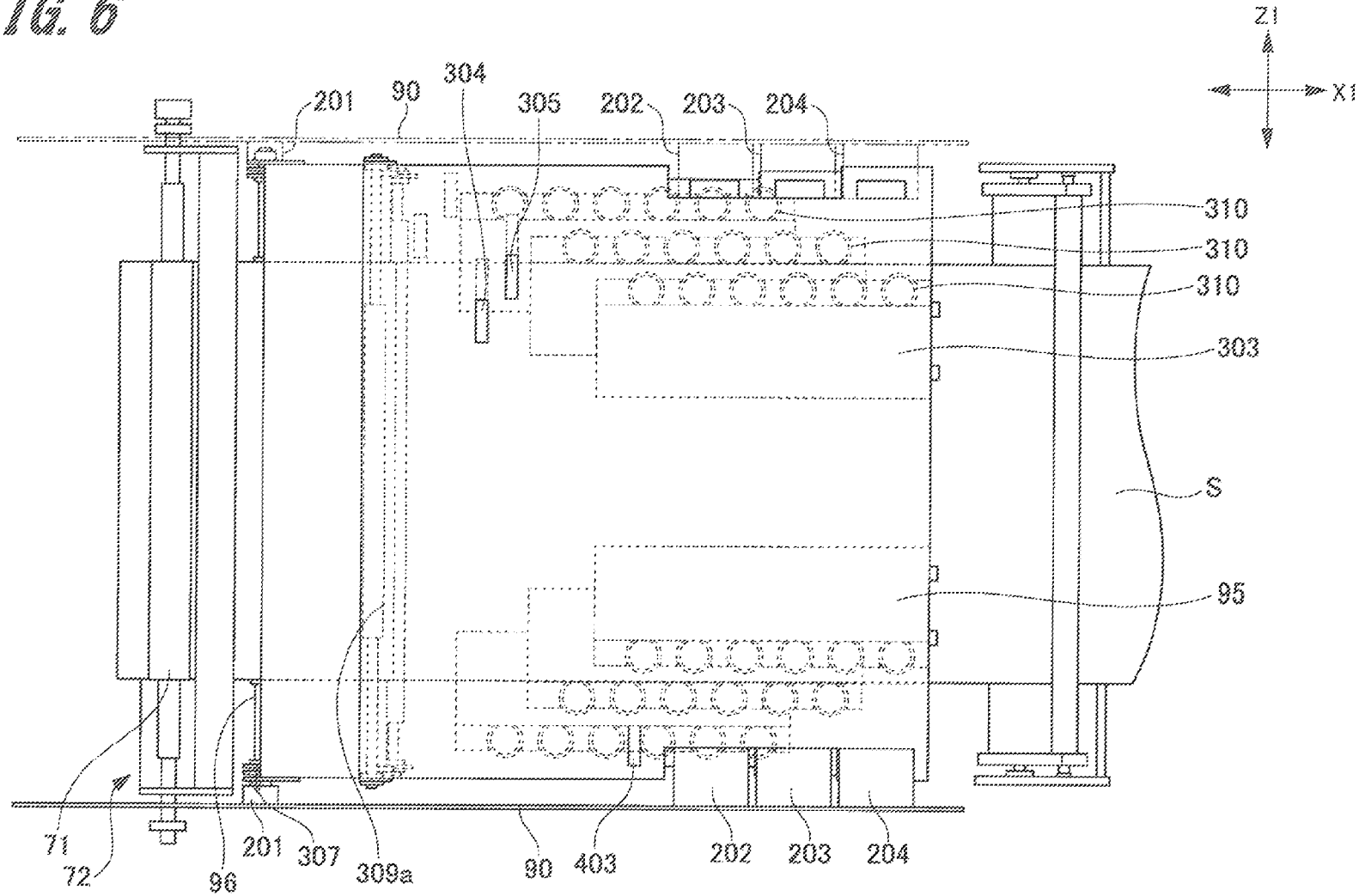
FIG. 6 is a plan view illustrating the conveying unit according to the example of the embodiment of the present invention when viewed from below in the vertical direction.

FIG. 2 is a perspective view illustrating the conveying unit 80, and FIG. 3 is an elevation view illustrating the conveying unit 80. FIG. 4 and FIG. 5 are perspective views each illustrating main portions of the conveying unit 80 in an enlarged manner. FIG. 6 is a plan view illustrating the conveying unit 80 when viewed from below in the vertical direction.

As illustrated in FIG. 2 and FIG. 3, the conveying unit 80 includes a pair of conveyance supporting bases 90, pairs of a guide rail 91 and a slider 92 constituting a movement mechanism, a first conveying member 93, a second conveying member 94, a third conveying member 95, and a reference roller member 96. Furthermore, the first conveying member 93 forms the first conveying path 81, and the second conveying member 94 forms the second conveying path 82. In addition, the third conveying member 95 forms the third conveying path 83.

The pair of conveyance supporting bases 90 is arranged at predetermined intervals in the width direction Z1 of the label roll sheet S. Furthermore, as illustrated in FIG. 1, the slider 92 is fixed at each end portion of each of the conveyance supporting bases 90 in the sheet conveying direction X1. The slider 92 is slidably supported by the guide rail 91 provided to the apparatus body 5 of the image forming apparatus 1. The guide rail 91 extends along the width direction Z1. Therefore, the pair of conveyance supporting bases 90 is supported by the guide rail 91 and the slider 92 so as to be able to be inserted into and detached from the apparatus body 5 of the image forming apparatus 1 in the width direction Z1.

In addition, a transfer lower unit 72 constituting the secondary transfer section 70 is fixed to the conveyance supporting base 90. The transfer lower roller 71 is rotatably supported by the transfer lower unit 72. Additionally, as illustrated in FIG. 4, the transfer lower unit 72 is provided with a sheet pressing plate 73 that prevents the label roll sheet S from floating in the vertical direction Y1. The sheet pressing plate 73 extends by a predetermined length along the width direction Z1.

Furthermore, in this example, there is prepared a plurality of transfer lower rollers 71 in which roller sections 71*a* brought into contact with the label roll sheet S have lengths different from each other in the width direction Z1. Furthermore, it becomes possible to select a transfer lower roller 71 having an appropriate length of a roller section 71*a* in the width direction Z1 in accordance with the length of the label roll sheet S in the width direction Z1, and attach the selected roller to the transfer lower unit 72.

As illustrated in FIG. 2 and FIG. 3, the conveyance supporting base 90 is formed substantially into a flat plate shape. The conveyance supporting base 90 includes a reference bearing portion 201 and three fixing pieces 202, 203, and 204. The reference bearing portion 201, and the three fixing pieces 202, 203, and 204 are provided on surfaces of the respective paired conveyance supporting bases 90, these surfaces facing each other.

The reference bearing portion 201 is disposed in the upper portion of the conveyance supporting base 90 in the vertical direction Y1 and in the vicinity of the upstream side of the transfer lower unit 72 in the sheet conveying direction X1. Furthermore, as illustrated in FIG. 5, a cutout is formed in the upper portion of the reference bearing portion 201 in the vertical direction Y1.

As illustrated in FIG. 3, in the conveyance supporting base 90, the three fixing pieces 202, 203, and 204 are disposed on the upstream side in the sheet conveying direction X1. The first fixing piece 202 is disposed in the upper portion of the conveyance supporting base 90 in the vertical direction Y1, and the third fixing piece 204 is disposed in the lower portion of the conveyance supporting base 90 in the vertical direction Y1. In addition, the second fixing piece 203 is disposed between the first fixing piece 202 and the third fixing piece 204.

Furthermore, as illustrated in FIG. 6, the first fixing piece 202, the second fixing piece 203, and the third fixing piece 204 are disposed in this order from the downstream side toward the upstream side in the sheet conveying direction X1. Therefore, the first fixing piece 202, the second fixing piece 203, and the third fixing piece 204 are provided so that they do not overlap each other when the conveyance supporting base 90 is viewed from the vertical direction Y1. Additionally, as illustrated in FIG. 2 and FIG. 3, the first fixing piece 202, the second fixing piece 203, and the third fixing piece 204 each have a holding magnet 206 fixed thereto, which is one example of a holding mechanism.

Furthermore, the conveyance supporting base 90 is detachably provided with the first conveying member 93, the second conveying member 94, the third conveying member 95, and the reference roller member 96.

The reference roller member 96 includes a reference roller 96*a* to be in contact with the label roll sheet S, a shaft portion 96*b* extending from both ends of the reference roller 96*a* in the axial direction thereof, and a cylindrical engagement reception portion 96*c* provided at an end portion of the shaft portion 96*b*.

As illustrated in FIG. 5, the engagement reception portion 96*c* is rotatably supported by the reference bearing portion 201 provided to the conveyance supporting base 90. Here, since the cutout is formed in the upper portion of the reference bearing portion 201 in the vertical direction Y1, the reference roller member 96 can be detachably attached to the reference bearing portion 201.

In addition, as illustrated in FIG. 3, the reference roller member 96, when being attached to the conveyance supporting base 90, serves as the roller member disposed closest to the transfer lower roller 71 of the secondary transfer section 70, on the upstream side of the transfer lower roller 71 in the sheet conveying direction X1. Furthermore, in this example, there is prepared a plurality of base roll members 96 of which reference rollers 96*a* have different lengths in the width direction Z1. In addition, it is possible to select an appropriate reference roller member 96 from among the plurality of reference roller members 96 of which reference rollers 96*a* have different lengths in the width direction Z1, according to the length of the label roll sheet S to be conveyed, in the width direction Z1.

For example, at the time of selecting the reference roller member 96, a reference roller member 96 of which reference roller 96*a* has a length in the width direction Z1 shorter than the length of the conveyed label roll sheet S in the width direction Z1 is selected. With this selection, it is possible to prevent an adhesive agent projecting from the end portion of the label roll sheet S in the width direction, from adhering to the reference roller 96*a*. As a result, it is possible to reduce time and effort required for cleaning the reference roller member 96.

Furthermore, even when taking out a reference roller member 96 from the conveyance supporting base 90 in order to clean the reference roller member 96, it is possible to attach another clean reference roller member 96 to the conveyance supporting base 90, by preparing the plurality of reference roller members 96. Therefore, it is possible to perform image forming processing in the image forming system 100 while cleaning the reference roller member 96 that has been already used, whereby it is possible to enhance productivity.

As illustrated in FIG. 2 and FIG. 3, the first conveying member 93, the second conveying member 94, and the third conveying member 95 each have a conveying guide plate 301 in a substantially flat plate shape, a conveying roller member 309, and two regulation members 303.

As illustrated in FIG. 3, the first conveying member 93, the second conveying member 94, and the third conveying member 95 are attached to the conveyance supporting base 90 so that main surface portions 301*a* of the conveying guide plates 301 thereof are parallel to each other. In addition, the conveying guide plate 301 of each of the second conveying member 94 and the third conveying member 95 is shaped such that the downstream side of a main surface portion 301*a* in the sheet conveying direction X1 is bent upward in the vertical direction Y1. The conveying guide plate 301 of the third conveying member 95, which is disposed lower than the second conveying member 94 in the vertical direction Y1, has a bending angle greater than that of the conveying guide plate 301 of the second conveying member 94.

The end portion of the conveying guide plate 301 disposed on the downstream side in the sheet conveying direction X1 of each of the first conveying member 93, the second conveying member 94, and the third conveying member 95 extends toward the reference roller member 96. Therefore, the label roll sheet S that has passed through the first conveying member 93, the second conveying member 94, or the third conveying member 95 passes through the reference roller member 96 before conveyed to the secondary transfer section 70.

In addition, the conveyance distance of the first conveying path 81 formed by the first conveying member 93, from the introduction conveying section 23 to the reference roller member 96, is set to be the shortest. Additionally, the conveyance distance of the third conveying path 83 formed by the third conveying member 95, from the introduction conveying section 23 to the reference roller member 96, is set to be the longest.

An engagement hook portion 307, a holding section 308, and a guide bearing portion 306 are provided at both end portions of the conveying guide plate 301 in the width direction Z1.

The engagement hook portion 307 is formed at the end portion on the downstream side of the conveying guide plate 301 in the sheet conveying direction X1. As illustrated in FIG. 4 and FIG. 5, the engagement hook portion 307 is detachably engaged with the engagement reception portion 96*c* of the reference roller member 96 attached to the reference bearing portion 201 of the conveyance supporting base 90. Therefore, the reference roller member 96 serves as a reference position for attaching the conveying guide plate 301 of each of the first conveying member 93, the second conveying member 94, and the third conveying member 95.

The guide bearing portion 306 is disposed in the vicinity of the engagement hook portion 307 of the conveying guide plate 301. In addition, the guide bearing portion 306 protrudes upward from the end portion of the conveying guide plate 301 in the vertical direction Y1. Additionally, the guide bearing portion 306 rotatably supports the conveying roller member 309.

The guide bearing portion 306 of each of the second conveying member 94 and the third conveying member 95 is disposed at a bent portion of the conveying guide plate 301.

The conveying roller member 309 includes a roller section 309*a* and a shaft portion 309*b*. The roller section 309*a* is to be brought into contact with the label roll sheet S to be conveyed. In addition, the shaft portion 309*b* protrudes from both end portions of the roller section 309*a* in the width direction Z1 toward the width direction Z1. The shaft portion 309*b* is rotatably supported by the guide bearing portion 306. Note that the label roll sheet S continuously extends between the roller section 309*a* of the conveying roller member 309 and the conveying guide plate 301.

Furthermore, as illustrated in FIG. 6, the length of the roller section 309*a* of the first conveying member 93 in the width direction Z1 is set to be longer than the length of the roller section 309*a* of each of the second conveying member 94 and the third conveying member 95 in the width direction Z1. In addition, the length of the roller section 309*a* of the second conveying member 94 in the width direction Z1 is set to be longer than the length of the roller section 309*a* of the third conveying member 95 in the width direction Z1.

The holding section 308 is disposed on the upstream side in the conveying guide plate 301 in the sheet conveying direction. The holding section 308 is sucked and held by magnetic force of the holding magnet 206 provided at the fixing piece 202 of the conveyance supporting base 90.

As illustrated in FIG. 3, the transfer lower roller 71 and the reference roller member 96 to be brought into contact with the label roll sheet S apply a certain tension to the label roll sheet S, and thus, are disposed higher than the conveying roller member 309 in the vertical direction Y1. Therefore, when the label roll sheet S passes through the conveying roller member 309 and the conveying guide plate 301, the conveying guide plate 301 is pulled by the label roll sheet S, upward in the vertical direction Y1. In contrast, in this example, the conveying guide plate 301 is sucked and held by the holding magnet 206 provided to the conveyance supporting base 90. With this configuration, it is possible to prevent the conveying guide plate 301 from being pulled by the label roll sheet S and being lifted upward in the vertical direction Y1.

Note that, in this example, there has been explained an example in which the holding magnet 206 is used as a holding mechanism that holds the conveying guide plate 301, but the holding mechanism is not limited to this. It may be possible to apply a hook piece, bolt and nut, or other various types of holding mechanisms as the holding mechanism that holds the conveying guide plate 301.

Figure 7A:
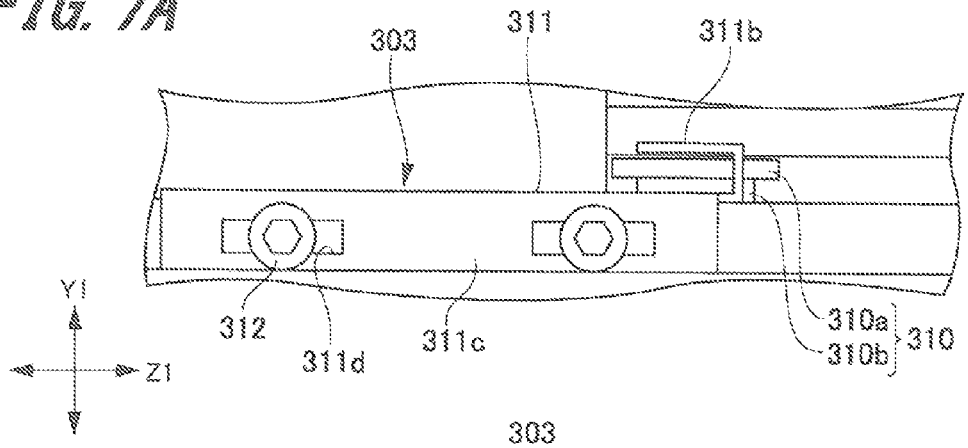
FIG. 7A, FIG. 7B, and FIG. 7C are explanatory views each illustrating a regulation member of the conveying unit according to the example of the embodiment of the present invention.
Figure 7B:
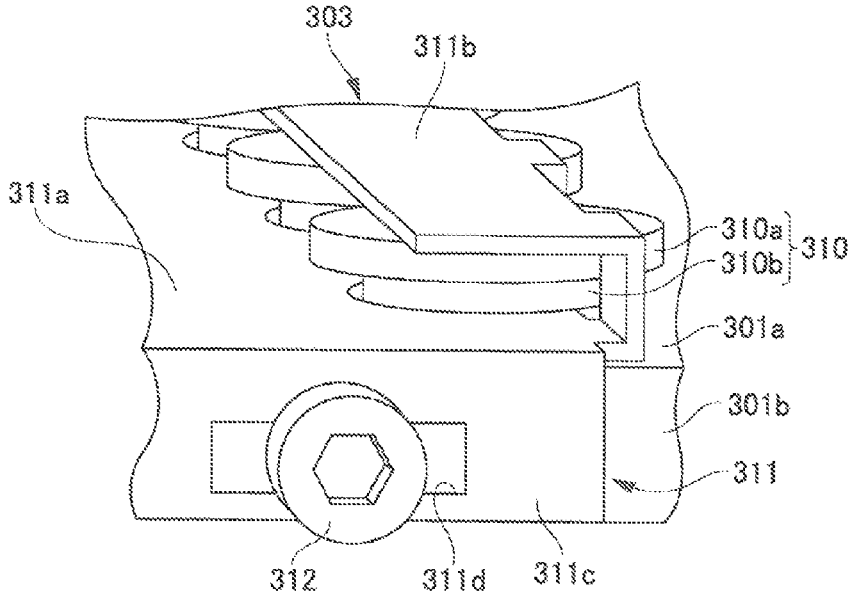
Figure 7C:
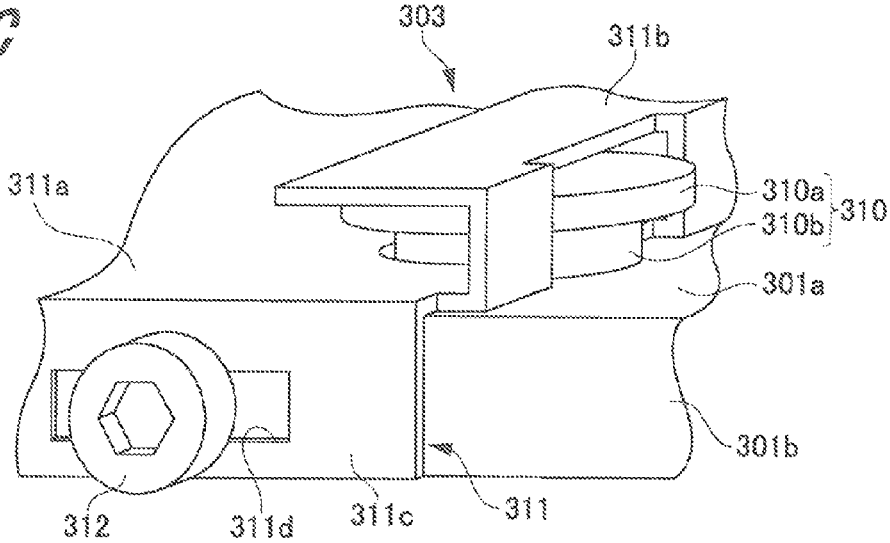

FIG. 7A to FIG. 7C are diagrams each illustrating a regulation member 303.

As illustrated in FIG. 7A to FIG. 7C, the regulation member 303 includes a plurality of conveying rollers 310 and a roller holder 311 that rotatably holds the conveying rollers 310. Each of the conveying rollers 310 includes a disk-shaped flange portion 310*a*, and a cylindrical contact portion 310*b*. The diameter of the contact portion 310*b* is set to be smaller than the diameter of the flange portion 310*a*. Furthermore, the end portion of the conveyed label roll sheet S in the width direction Z1 is brought into contact with the outer peripheral surface of the contact portion 310*b*.

The roller holder 311 includes a placing surface section 311*a* that is placed on the main surface portion 301*a* of the conveying guide plate 301, a roller holding section 311*b* that rotatably holds the conveying roller 310, and a fixing piece 311*c*. In addition, the axial direction of the conveying roller 310 held by the roller holding section 311*b* is set so as to be parallel to the vertical direction Y1. Furthermore, as illustrated in FIG. 7A and FIG. 7C, when the conveying roller 310 is held by the roller holding section 311*b*, the contact portion 310*b* of the conveying roller 310 protrudes externally in the width direction Z1 from the roller holding section 311*b*. With this configuration, at the time of cleaning the regulation member 303, it is possible to easily clean the contact portion 310*b*, which is to be brought into contact with the end portion of the label roll sheet S.

As illustrated in FIG. 7A, the fixing piece 311*c* is provided with a fixing hole 311*d* into which a fixing screw 312 is inserted. In addition, the fixing piece 311*c* is fastened via the fixing screw 312 to the end portion of the conveying guide plate 301 located on the upstream side in the sheet conveying direction X1. The fixing hole 311*d* is an oblong hole extending in the width direction Z1. Therefore, it is possible to adjust the position of the regulation member 303 in the width direction Z1 with respect to the conveying guide plate 301.

Furthermore, as illustrated in FIG. 6, the distance in the width direction Z1 between two regulation members 303 attached to the conveying guide plate 301 is set according to the length of the conveyed label roll sheet S in the with direction Z1. At this time, it is possible to prevent the label roll sheet S from meandering during conveyance, by bringing each end portion of the label roll sheet S in the width direction Z1 into contact with the conveying roller 310. Here, tension increases with an increase in the length in the width direction Z1, and the pressure acting on the roller section 309*a* or the conveying roller 310 increases.

Therefore, the distance in the width direction Z1 between two regulation members 303 attached to the first conveying member 93, of which conveyance distance is shorter than that of the other conveying paths, is set to be longer than the distance in the width direction Z1 between two regulation members 303 attached to the other conveying members. In addition, the distance in the width direction Z1 between two regulation members 303 attached to the third conveying member 95, of which conveyance distance is longer than that of the other conveying paths, is set to be shorter than the distance in the width direction Z1 between two regulation members 303 attached to the other conveying members.

Namely, a label roll sheet S having the longest length of label roll sheets S, in the width direction Z1, passing through the three conveying paths continuously extends in the first conveying path 81 formed by the first conveying member 93 having the shortest conveyance distance. Furthermore, a label roll sheet S having the shortest length of label roll sheets S, in the width direction Z1, passing through the three conveying paths continuously extends in the third conveying path 83 formed by the third conveying member 95 having the longest conveyance distance.

As described above, it is possible to reduce pressure acting on the conveying path from the label roll sheet S, by limiting the length of the label roll sheet S continuously extending, in the width direction Z1, according to the conveyance distance from the introduction conveying section 23 to the reference roller member 96. This makes it possible to stabilize conveyance processing of the label roll sheet S by the conveying unit 80.

Furthermore, as illustrated in FIG. 3 and FIG. 6, the first conveying member 93, the second conveying member 94, and the third conveying member 95 each include a sheet-width detecting sensor 304 and a conveyance path-in-use detecting sensor 305. The sheet-width detecting sensor 304 detects the length of the conveyed label roll sheet S in the width direction Z1. Additionally, the conveyance path-in-use detecting sensor 305 detects the conveyed label roll sheet S to thereby detect whether or not which one of the three conveying path 81, 82, and 83 is used.

Moreover, the conveying unit 80 includes a first conveying-member presence or absence sensor 401, a second conveying-member presence or absence sensor 402, and a third conveying-member presence or absence sensor 403. The first conveying-member presence or absence sensor 401 detects the presence or absence of the conveying guide plate 301 of the first conveying member 93. The second conveying-member presence or absence sensor 402 detects the presence or absence of the conveying guide plate 301 of the second conveying member 94, and the third conveying-member presence or absence sensor 403 detects the presence or absence of the conveying guide plate 301 of the third conveying member 95.

Figure 8:
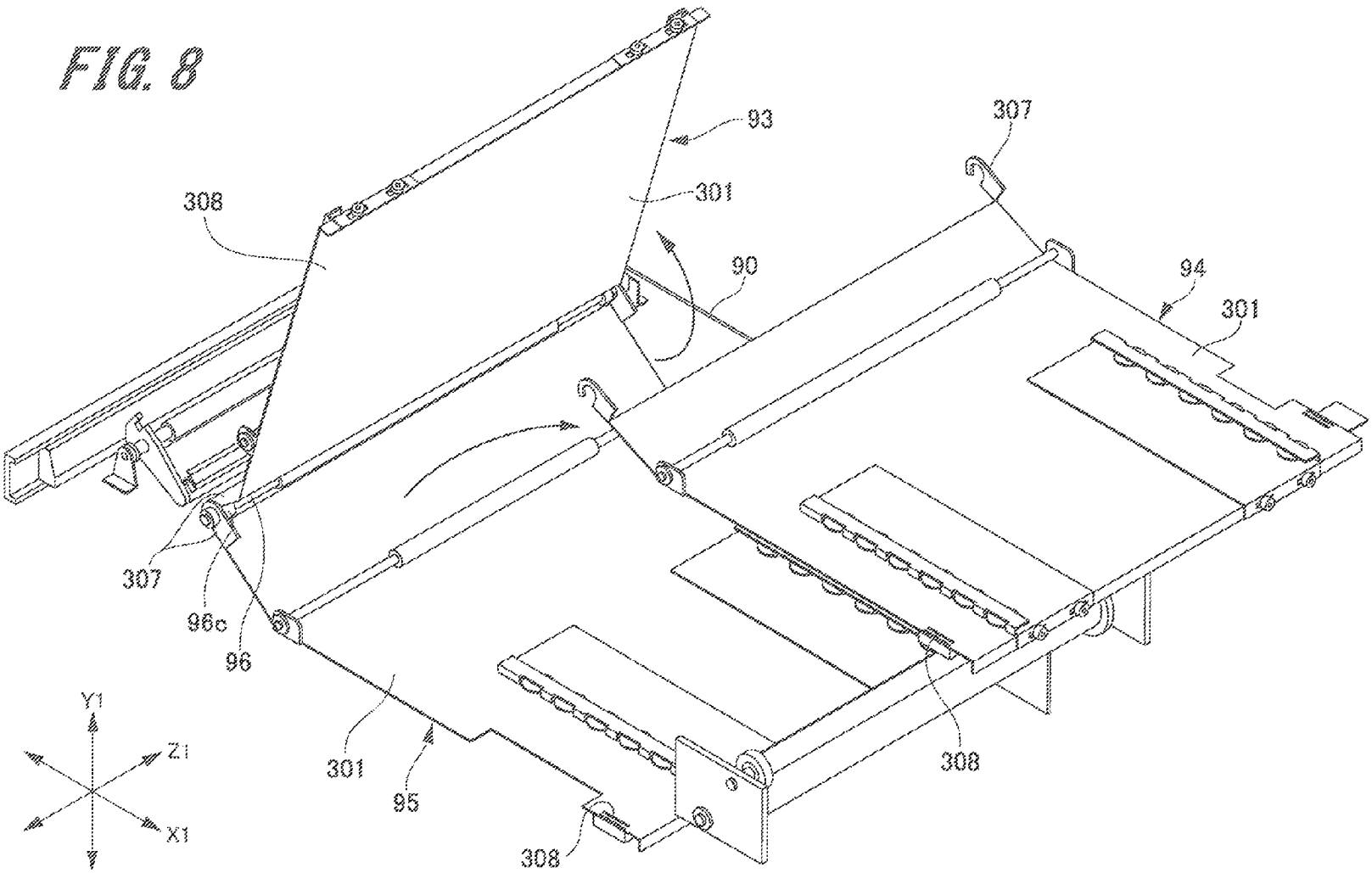
FIG. 8 is a perspective view illustrating a state where a conveying member is detached from the conveying unit according to the example of the embodiment of the present invention.

FIG. 8 is a perspective view illustrating a state where the second conveying member 94 is taken out from the conveying unit 80.

First, as illustrated in FIG. 8, the holding section 308 of the conveying guide plate 301 of the first conveying member 93 is detached from the holding magnet 206. Next, the conveying guide plate 301 of the first conveying member 93 is turned around the axial center of the reference roller member 96. As a result, the upper portion of the conveying guide plate 301 of the second conveying member 94 in the vertical direction Y1 is opened.

Then, the holding section 308 of the conveying guide plate 301 of the second conveying member 94 is detached from the holding magnet 206, and the engagement hook portion 307 is taken out from the engagement reception portion 96*c* of the reference roller member 96. Furthermore, the conveying guide plate 301 of the first conveying member 93 is turned to the original position illustrated in FIG. 2. With this operation, it is possible to take out only the conveying guide plate 301 of the second conveying member 94 from the conveyance supporting base 90.

Moreover, in the case where the conveying guide plate 301 of the third conveying member 95 is taken out, the conveying guide plate 301 of the first conveying member 93 and the conveying guide plate 301 of the second conveying member 94 are turned. With this operation, the upper portion of the conveying guide plate 301 of the third conveying member 95 in the vertical direction Y1 is opened, and it is possible to take out only the conveying guide plate 301 of the third conveying member 95 from the conveyance supporting base 90.

Note that, when taking out the conveying guide plate 301 of the first conveying member 93, it is possible to take out the engagement hook portion 307 from the engagement reception portion 96*c* of the reference roller member 96 and to detach the holding section 308 from the holding magnet 206.

As described above, it is possible to separately take out the three conveying member 93, 94, and 95 from the conveyance supporting base 90. Therefore, when performing cleaning operation on any one of the three conveying members 93, 94, and 95, two conveying members remain in the conveying unit 80. Accordingly, it is possible to perform image forming processing on the label roll sheet S by using the remaining two conveying members while performing the cleaning operation, whereby it is possible to prevent a reduction in operational efficiency.

Note that, at the time of cleaning operation, the conveying member 93, 94, and 95 to be cleaned may not be taken from the conveyance supporting base 90, and the label roll sheet S may be conveyed using the remaining conveying member.

Furthermore, in this example, the roller member 309 and the regulation member 303 are attached to the conveying guide plate 301. With this configuration, only by taking out the conveying guide plate 301 from the conveyance supporting base 90, it is also possible to take out the conveying roller member 309 and the regulation member 303 corresponding to the conveying path together with the conveying guide plate 301.

Note that there has been explained an example in which three conveying paths are provided to the conveying unit 80, but the number of conveying paths is not limited to this. The number of conveying paths provided to the conveying unit 80 may be two, or four or more.

[Configuration of Control System]

Next, a configuration of a control system of the image forming apparatus 1 constituting the image forming system 100 will be explained with reference to FIG. 9.

FIG. 9 is a block diagram illustrating a configuration of the control system of the image forming apparatus 1 constituting the image forming system 100.

As illustrated in FIG. 9, the image forming apparatus 1 includes the control section 60, an image processing section 36, the image forming section 40, the operation display section 65, an HDD 64, the fixing section 10, the conveying unit 80, and a communication section 66.

The control section 60 includes, for example, a central processing unit (CPU) 61, a read only memory (ROM) 62 for storing a program or the like the CPU 61 carries out, and a random access memory (RAM) 63 used as a working area for the CPU 61. Note that a programmable ROM in which programs can be electrically deleted is used as the ROM 62.

The control section 60 is connected via a system bus 107 to the image processing section 36, the image forming section 40, the operation display section 65, the HDD 64, the fixing section 10, the conveying unit 80, and the communication section 66, and controls the entire image forming apparatus 1. Furthermore, the control section 60 controls each section of the sheet feeding device 2 and the sheet ejection device 3 via the communication section 66. Namely, in this example, the control section 60 controls the entire image forming system 100.

Image data transmitted from the personal computer (PC) 120, which is one example of an external device connected to the image forming apparatus 1, is sent to the image processing section 36, and is subjected to image processing in the image processing section 36. The image processing section 36 performs image processing such as shading correction, image density adjustment, and image compression, on the received image data as necessary under control of the control section 60. In addition, the image forming section 40 receives the image data subjected to image processing applied thereto by the image processing section 36 under control of the control section 60, and forms an image on the roll sheet S on the basis of the image data.

The conveying unit 80 transmits, to the control section 60, sensor signals detected by the sheet-width detecting sensor 304, the conveyance path-in-use detecting sensor 305, the first conveying-member presence or absence sensor 401, the second conveying-member presence or absence sensor 402, and the third conveying-member presence or absence sensor 403.

Furthermore, a user inputs the length of the label roll sheet S in the width direction Z1 or a conveying path that conveys the label roll sheet S, in the operation display section 65.

The communication section 66 serves as a communication interface for connecting to a network to which each device constituting the image forming system 100 is connected. For example, the image forming apparatus 1 performs serial communication with the sheet feeding device 2 and the sheet ejection device 3 via the communication section 66.

2. Method of Controlling Image Forming System

Next, a method of controlling the image forming system 100 having the configuration described above will be explained with reference to FIG. 10 to FIG. 12.

First, an operational flow from the loading of sheet to the start of printing will be explained with reference to FIG. 10.

Figure 10:
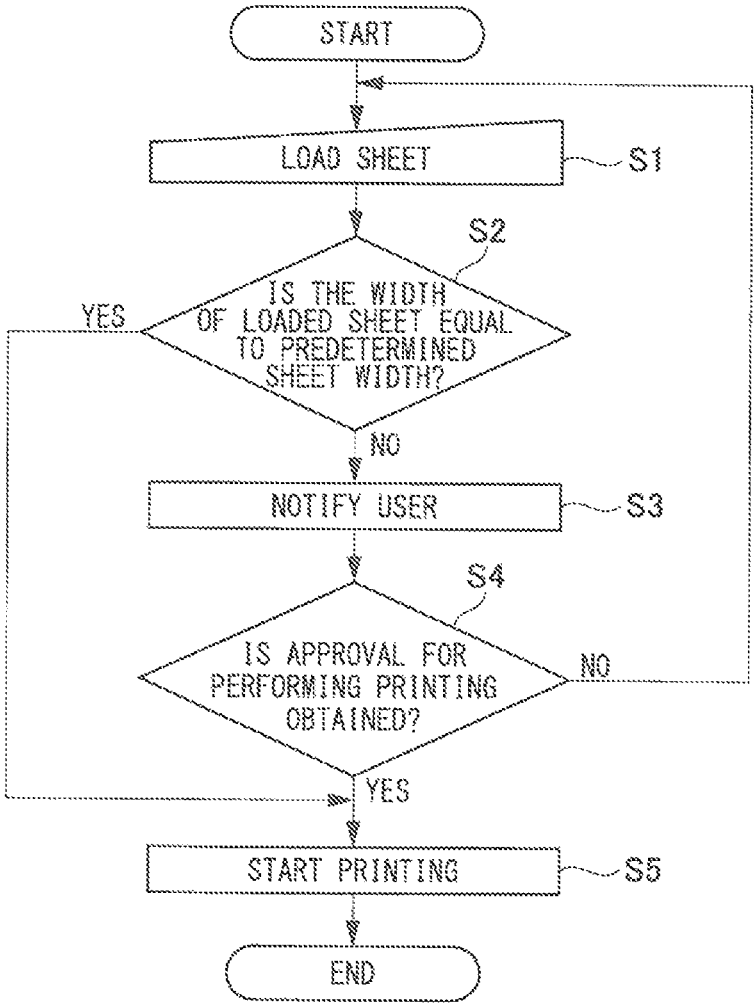
FIG. 10 is a flowchart showing an example of operations of the image forming system according to the example of the embodiment of the present invention.

FIG. 10 is a flowchart showing an example of operations of the image forming system 100 from the loading of sheet to the start of printing. Note that the control section 60 of the image forming apparatus 1 causes the CPU 61 to execute a program stored in the ROM 62, thereby achieving processing in the flowchart shown in FIG. 10.

As illustrated in FIG. 10, a user first pulls out a label roll sheet S from the sheet feeding device 2, and loads the label roll sheet S into a predetermined conveying path of the conveying unit 80 in the image forming apparatus 1 (step S1). Next, the control section 60 determines, on the basis of the detection signal from the sheet-width detecting sensor 304 of the conveying path into which the sheet is loaded, whether or not the length of the loaded label roll sheet S in the width direction Z1 is equal to the length of a predetermined sheet width, namely, the sheet width set to the conveying path for conveying the loaded label roll sheet S (step S2).

Next, when the control section 60 determines in the processing of step S2 that the length of the loaded label roll sheet S in the width direction Z1 is equal to the predetermined sheet width (determined as YES in S2), the control section 60 starts printing for the loaded label roll sheet S (step S5).

On the other hand, when the control section 60 determines in the processing of step S2 that the length of the loaded label roll sheet S in the width direction Z1 is not equal to the predetermined sheet width (determined as NO in S2), the control section 60 notifies the user of the fact that the length of the loaded label roll sheet S in the width direction Z1 differs from the sheet width set to the conveying path for conveying the sheet (step S3). The method of notifying the user includes, for example, a method using voice, and a method of performing display on the operation display section 65.

Next, after the control section 60 performs notification processing on the user, the control section 60 determines whether or not approval for performing printing is obtained from the user (step S4). If approval for performing printing is not obtained from the user in the processing of step S4 (determined as NO in S4), the flow returns to the processing of step S2 again, and the user changes a conveying path that conveys the label roll sheet S, or loads a label roll sheet S having a correct sheet width.

On the other hand, when the control section 60 determines in the processing of step S4 that approval for performing printing is obtained (determined as YES in S4), the control section 60 starts printing to the loaded label roll sheet S (step S5). Then, operations from loading of the sheet to start of printing are ended.

Next, an example of operations in the image forming system 100 after the sheet is loaded will be explained with reference to FIG. 11.

Figure 11:
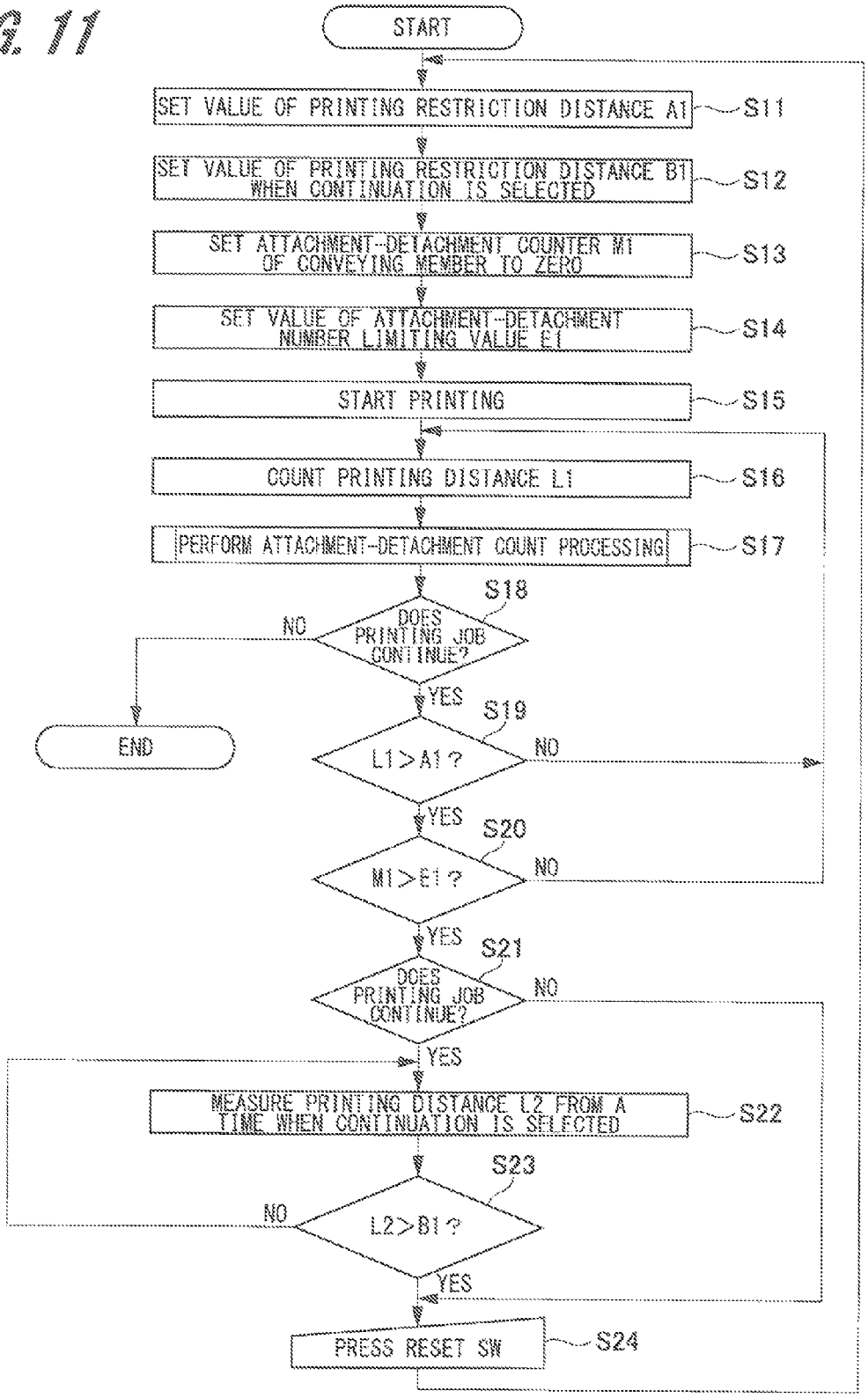
FIG. 11 is a flowchart showing an example of operations of the image forming system according to the example of the embodiment of the present invention.

FIG. 11 is a flowchart showing an example of operations in the image forming system 100 after the sheet is loaded. Note that the control section 60 of the image forming apparatus 1 causes the CPU 61 to execute a program stored in the ROM 62, thereby achieving processing in the flowchart shown in FIG. 11.

First, as illustrated in FIG. 11, when the image forming system 100 is turned ON, the control section 60 sets a value of a printing restriction distance A1 for a conveying member to be used (step S11). In this example, the printing restriction distance A1 is set, for example, to "1500." Next, the control section 60 sets a value of a printing restriction distance B1 when continuation is selected for a conveying member to be used (step S12). For example, the printing restriction distance B1 when continuation is selected is set to "200."

Subsequently, the control section 60 sets a value of an attachment-detachment counter M1, which indicates the number of times of detachment of the conveying member to be used, to "0" (step S13). Furthermore, the control section 60 sets a value of an attachment-detachment number limiting value E1 of the conveying member to be used (step S14). Note that, in this example, the value of the attachment-detachment number limiting value E1 is set to "0."

Note that, in the same way as in the case where other conveying members are used, the control section 60 performs the processing from step 11 to step S14.

Subsequently, the control section 60 controls each section in the image forming apparatus 1, the sheet feeding device 2, and the sheet ejection device 3 to operate the image forming system 100, thereby starting printing (step S15). When starting printing, the control section 60 measures a printing distance L1 which serves as a distance for which the label roll sheet S is conveyed (step S16). The measurement of the printing distance L1 is obtained on the basis of, for example, the number of rotations of photoreceptor 41 or rollers in each part.

Then, the control section 60 performs attachment-detachment count processing in which the number of times that the conveying member is detached from the conveyance supporting base 90 is counted (step S17). After that, the control section 60 prompts the user to determine whether or not printing JOB is continued, and determines whether or not the printing JOB is continued (step S18).

When the user determines that the printing JOB should be ended, the control section 60 determines in the processing of step S18 that continuation of the printing JOB ends (determined as NO in S18). In this case, the control section 60 ends the printing JOB.

On the other hand, when the user determines that the printing JOB should continue, and the control section 60 determines in the processing of step S18 that the printing JOB continues (determined as determined as YES in S18), the control section 60 determines whether or not the printing distance L1 exceeds the printing restriction distance A1 (step S19). When the control section 60 determines in the processing of step S19 that the printing distance L1 has not yet exceeded the printing restriction distance A1 (determined as determined as NO in S19), the control section 60 returns to the processing of step S16 again, and counts the printing distance L1.

On the other hand, when the control section 60 determines in the processing of step S19 that the printing distance L1 exceeds the printing restriction distance A1 (determined as determined as YES in S19), the control section 60 determines whether or not the attachment-detachment counter M1 exceeds the attachment-detachment number limiting value E1 (step S20). Note that, in this example, since the value of the attachment-detachment number limiting value E1 is set to "0," the attachment-detachment counter M1 exceeds the attachment-detachment number limiting value E1 if the conveying member is detached even only once.

When the control section 60 determines in the processing of step S20 that the attachment-detachment counter M1 does not exceed the attachment-detachment number limiting value E1 (determined as determined as NO in S20), the control section 60 returns to the processing of step S16 again, and counts the printing distance L1. As described above, since the value of the attachment-detachment number limiting value E1 is set to "0," a state where the attachment-detachment counter M1 does not exceed the attachment-detachment number limiting value E1 means that the conveying member has never once been detached.

On the other hand, when the control section 60 determines in the processing of step S20 that the attachment-detachment counter M1 does exceed the attachment-detachment number limiting value E1 (determined as determined as YES in S20), the control section 60 prompts the user to determine whether or not printing JOB is continued, and determines whether or not the printing JOB is continued (step S21).

When the user determines that the printing JOB should continue and the control section 60 determines in the processing of step S21 that the printing JOB continues (determined as determined as YES in S21), the control section 60 counts a printing distance L2 when continuation is selected (step S22).

On the other hand, when the user determines that the printing JOB should be ended, the control section 60 determines in the processing of step S21 that the continuation of the printing JOB ends (determined as NO in S21). In this case, the control section 60 causes the user to press a reset switch without fail, to reset a value of each of the printing restriction distance A1, the printing restriction distance B1 when continuation is selected, the attachment-detachment counter M1, and the attachment-detachment number limiting value E1 (step S24). Then, the control section 60 moves to the next job. Furthermore, it is highly possible that the conveying guide plate 301, the conveying roller member 309, or the regulation member 303, each of which constitutes the conveying member, has become stained due to an adhesive agent of the label roll sheet because the same conveying member is being used in a state where the printing distance L1 exceeds the printing restriction distance A1. Therefore, the control section 60 recommends that the user should clean the conveying member.

Furthermore, when the processing of step S22 is completed, the control section 60 determines whether or not the printing distance L2 from continuation selection exceeds the printing restriction distance B1 when continuation is selected (step S23). When the control section 60 determines in the processing of step S23 that the printing distance L2 from continuation selection does not exceed the printing restriction distance B1 when continuation is selected (determined as NO in S23), the control section 60 returns to the processing of step S22 again, and counts the printing distance L2 from continuation selection.

On the other hand, when the control section 60 determines in the processing of step S23 that the printing distance L2 from continuation selection exceeds the printing restriction distance B1 when continuation is selected (determined as YES in S23), the control section 60 causes the user to press a reset switch without fail, to reset a value of each of the printing restriction distance A1, the printing restriction distance B1 when continuation is selected, the attachment-detachment counter M1, and the attachment-detachment number limiting value E1 (step S24). Furthermore, it is highly possible that the conveying guide plate 301, the conveying roller member 309, or the regulation member 303, each of which constitutes the conveying member, has become stained due to the adhesive agent of the label roll sheet, because the conveying member is being used in a state where the printing distance L2 from continuation selection exceeds the printing restriction distance B1 when continuation is selected. Therefore, the control section 60 recommends that the user should clean the conveying member.

Next, a process flow for the attachment-detachment count processing will be explained with reference to FIG. 12.

Figure 12:
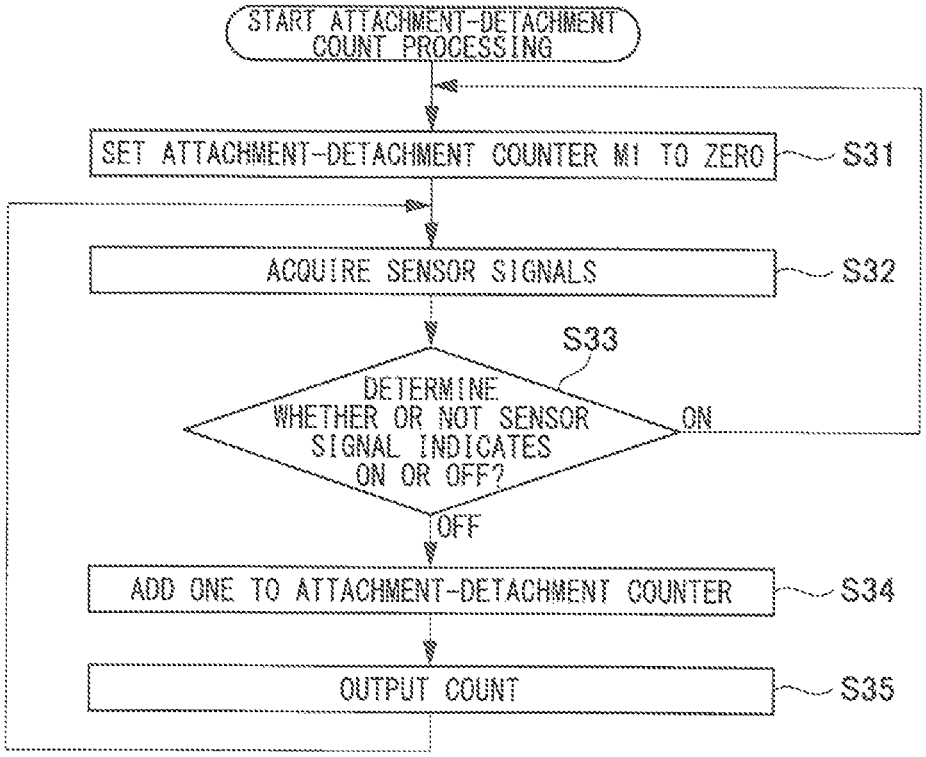
FIG. 12 is a flowchart showing an example of attachment-detachment count processing in the image forming system according to the example of the embodiment of the present invention.

FIG. 12 is a flowchart showing an example of the attachment-detachment count processing in which the number of times of the detachment of the conveying member is counted.

As illustrated in FIG. 12, first, the control section 60 sets the value of the attachment-detachment counter M1 to "0" (step S31). Next, the control section 60 acquires sensor signals (step S32). The sensor signals obtained in this step S32 are detection signals from the first conveying-member presence or absence sensor 401, the second conveying-member presence or absence sensor 402, and the third conveying-member presence or absence sensor 403, each of which detects the presence or absence of the conveying member.

Next, the control section 60 determines whether the acquired sensor signals indicate ON or OFF (step S33). If the control section 60 determines in the processing of step S33 that the acquired sensor signals indicate ON, the control section 60 returns to the processing of step S31. Namely, in the case where the conveying member is attached to the conveyance supporting base 90, the detection signals of the conveying-member presence or absence sensors 401, 402, and 403 indicate ON.

On the other hand, when the control section 60 determines in the processing of step S33 that the acquired sensor signals indicate OFF, namely, if the conveying member is taken out from the conveyance supporting base 90, the control section 60 adds "1" to the attachment-detachment counter (step S34). Next, the control section 60 outputs a value counted (step S35). Namely, the value counted is stored in a storage section such as the RAM 63. Then, the control section 60 returns to the processing of step S32 again, and acquires the sensor signals. As described above, the control section 60 counts the number of times of attachment/detachment of the conveying member.

By counting the number of times of attachment/detachment of the conveying member and measuring the printing distance at the time of image printing, it is possible to give notification to the user in the case where the user forgets cleaning the conveying member.

As described above, there have been explained examples of embodiments of the image forming apparatus, including operation and effect thereof. However, the image forming apparatus according to the present invention is not limited to the embodiments described above, and various modifications are possible without departing from the gist of the present invention specified in the scope of claims.

In the example of the embodiment described above, a color image is formed using four image forming units 40Y, 40M, 40C, and 40K. However, the image forming apparatus according to the present invention may have a configuration in which a single-color image is formed using one image forming section. Furthermore, the image forming apparatus is not limited to a copy machine, and a printer, a facsimile device, or a multifunction machine having a plurality of functions may be possible.

BRIEF DESCRIPTION OF THE REFERENCE SYMBOLS

1 . . . image forming apparatus, 2 . . . sheet feeding device, 3 . . . sheet ejection device, 10 . . . fixing section, 11 . . . fixing belt, 12 . . . fixing roller (downstream-side conveying roller), 13 . . . heating roller, 14 . . . pressurizing roller (downstream-side conveying roller), 50 . . . intermediate transfer belt, 52 . . . belt cleaning section, 60 . . . control section, 70 . . . secondary transfer section (transfer section), 71 . . . transfer lower roller, 80 . . . conveying unit, 81 . . . first conveying path, 82 . . . second conveying path, 83 . . . third conveying path, 90 . . . conveyance supporting base, 91 . . . guide rail, 92 . . . slider, 93, 94, 95 . . . conveying member, 96 . . . reference roller member, 96*a* . . . reference roller, 96*c* . . . engagement reception portion, 201 . . . reference bearing portion, 206 . . . holding magnet (holding mechanism), 301 . . . conveying guide plate, 303 . . . regulation member, 304 . . . sheet-width detecting sensor, 305 . . . conveyance path-in-use detecting sensor, 307 . . . engagement hook portion, 308 . . . holding section, 309 . . . conveying roller member, 309*a* . . . roller section, 401, 402, 403 . . . conveying-member presence or absence sensor, S . . . roll sheet (recording medium), P1 . . . correction patch, R1 . . . curved portion

What is claimed is:

1. an image forming apparatus that conveys, from an introduction conveying section, a recording medium wound into a roll shape and having an adhesive surface, and that forms an image on the recording medium, the apparatus comprising:

a transfer section that transfers a toner image formed by an image forming section, to the recording medium;

a conveying unit that conveys the recording medium from the introduction conveying section to the transfer section; and an apparatus body that accommodates the transfer section and the conveying unit, wherein the conveying unit includes:

a conveyance supporting base that is supported so as to be able to be inserted into an detached from the apparatus body via a movement mechanism, and a plurality of conveying members that is attached to the conveyance supporting base in a detachable manner, and that forms a conveying path through which the recording medium is conveyed, each of the plurality of conveying members includes a conveying roller member and a guide plate supporting the recording medium in an area upstream of the conveying roller member.

2. the image forming apparatus according to claim 1, wherein the each of the plurality of conveying members further includes:

a regulation member that is attached to the conveying guide plate, and that is brought into contact with an end portion of the recording medium in a width direction, the guide plate being attached to the conveyance supporting base in a detachable manner.

3. The image forming apparatus according to claim 2, wherein the conveying unit includes:

a reference roller member that is disposed closer to the transfer section than the plurality of conveying members and is attached to the conveyance supporting base in a detachable manner, and an engagement hook portion that engages with the reference roller member in a detachable manner at an end portion of the conveying guide plate located on a downstream side in a sheet conveying direction.

4. The image forming apparatus according to claim 1, wherein the plurality of conveying members includes:

a first conveying member having the shortest conveyance distance from the introduction conveying section to the transfer section of the plurality of conveying members; and a second conveying member having the conveyance distance longer than the first conveying member, wherein a length of the recording medium in a width direction the first conveying member can convey is larger than a length of the recording medium in a width direction the second conveying member can convey.

5. The image forming apparatus according to claim 1, wherein the plurality of conveying members each includes a sheet-width detecting sensor that detects a length of the recording medium in a width direction.

6. The image forming apparatus according to claim 1, wherein the conveying unit includes a conveyance path-in-use detecting sensor that detects a conveying member that conveys the recording medium among the plurality of conveying members.

7. The image forming apparatus according to claim 1, wherein the conveying unit includes a conveying-member presence or absence sensor that detects a presence or absence of the plurality of conveying members.

8. An image forming system, comprising:

an image forming apparatus that conveys, from an introduction conveying section, a recording medium wound into a roll shape and having an adhesive surface, and forms an image on the recording medium; and a sheet feeding device that feeds the recording medium to the image forming apparatus, wherein the image forming apparatus includes:

a transfer section that transfers a toner image formed by an image forming section, to the recording medium;

a conveying unit that conveys the recording medium from the introduction conveying section to the transfer section; and an apparatus body that accommodates the transfer section and the conveying unit, and the conveying unit has:

a conveyance supporting base that is supported so as to be able to be inserted into an detached from the apparatus body via a movement mechanism, and a plurality of conveying members that is attached to the conveyance supporting base in a detachable manner, and that forms a conveying path through which the recording medium that is conveyed, each of the plurality of conveying members includes a conveying roller member and a guide plate supporting the recording medium in an area upstream of the conveying roller member.

* * * * *